US005830256A

United States Patent [19]

Northrop et al.

[11] Patent Number: 5,830,256

[45] Date of Patent: Nov. 3, 1998

[54] CEMENTED CARBIDE

[76] Inventors: Ian Thomas Northrop, 15A Main Road, Eastleigh, Edenvale, South Africa; Christopher Thomas Peters, Ballinacourty, Castleconnell, County Limerick, Ireland

[21] Appl. No.: 644,862

[22] Filed: May 10, 1996

[30] Foreign Application Priority Data

May 11, 1995 [ZA] South Africa ..... 94/8971

[51] Int. Cl.[6] ..... C22C 29/02

[52] U.S. Cl. ..... 75/236; 75/239; 75/240; 75/242

[58] Field of Search ..... 75/239, 240, 242, 75/236; 419/17, 18, 23

[56] References Cited

U.S. PATENT DOCUMENTS

| | | | |
|---|---|---|---|
| 3,647,401 | 3/1972 | Meadows . | |
| 3,981,062 | 9/1976 | Moskowitz et al. . | |
| 4,402,737 | 9/1983 | Kronenwetter et al. . | |
| 4,983,354 | 1/1991 | Reeder et al. | 419/11 |
| 5,057,147 | 10/1991 | Shaffer et al. | 75/252 |
| 5,071,473 | 12/1991 | Reeder et al. | 75/240 |

FOREIGN PATENT DOCUMENTS 203819 11/1955 Australia .

OTHER PUBLICATIONS

Derwent abstract of EP 214944, 1996 Derwent info Ltd.

Derwent abstract of 8637 US 4608318, 8536 GB 2098112, 8705 DE 3214552, 1996 Derwent Info Ltd.

Derwent abstract of WO 9400612 A, 1996 Derwent Info. Ltd.

*Primary Examiner*—Ngoclan Mai

*Attorney, Agent, or Firm*—Lowe, Price, LeBlanc & Becker

[57] ABSTRACT

A coarse grained cemented carbide is produced by sintering a mixture of coarse grain carbide particles having an average particle size of at least 10 microns and a nickel binder in particulate form. The cemented carbide has particular use in the manufacture of a cutting element for a soft rock mining tool or road planing tool.

4 Claims, 2 Drawing Sheets

THE MICROSTRUCTURE OF THE NICKEL BONDED INSERT

THE MICROSTRUCTURE OF THE COBALT BONDED INSERT

A CROSS SECTION THROUGH THE WEAR SURFACE OF NICKEL BONDED WC

A CROSS SECTION THROUGH THE WEAR SURFACE OF COBALT BONDED WC

CEMENTED CARBIDE

BACKGROUND OF THE INVENTION

This invention relates to cemented carbide and more particularly relates to a soft rock mining or road planing tool utilising a cemented carbide cutting element.

Cemented carbide, also known as hardmetal, is a material used extensively in the cutting and drilling industries and comprises a mass of carbide particles in a binder phase. The binder phase is generally a transition metal such as nickel, iron or cobalt.

The carbide will typically be tungsten carbide, tantalum carbide, titanium carbide or molybdenum carbide. Hardmetals are manufactured by sintering a mixture of carbide particles with binder phase in a particulate form.

Many modifications have been proposed to alter the properties of hardmetal to enhance its properties in various applications.

European Patent Publication No. 0288775 describes an earth working tool having a working element fabricated from cemented tungsten carbide compositions with enhanced properties. This is achieved using cobalt metal as the binder in a range 4,5% to 12,0% and coarse WC grains to achieve the desired properties It is known that cobalt based hardmetals suffer from stress corrosion cracking in acidic environments.

During drilling, the excess energy required to cut/fracture rock formations is transmitted into heat. This heat generated at the surface of the cutting element must be removed rapidly from the surface layers in order to avoid thermal damage. This local thermal cycling is dependent upon thermal conductivity and leads to thermal expansion and alternating tensile stress between the different temperature fields in the surface layers. If the tensile strength of the base hardmetal material is exceeded between the two temperature fields the well known "snakeskin" thermal cracking will occur. Propagation of these thermally induced cracks occur during prolonged drilling leading to premature fracture and reduced life of the components.

SUMMARY OF THE INVENTION

According to the present invention, a method of producing a cemented carbide comprises sintering a mixture of coarse grain carbide particles having an average particle size of at least 10 microns, and nickel binder in particulate form. The cemented carbide thus produced has a carbide phase and nickel binder phase and is more resistant to stress corrosion cracking under acidic water environments such as those encountered in mines. The invention extends to a cemented carbide produced by this method and to the use of such cemented carbide as a cutting element in a soft rock mining tool and a road planing tool.

DESCRIPTION OF EMBODIMENTS

Figure 1:
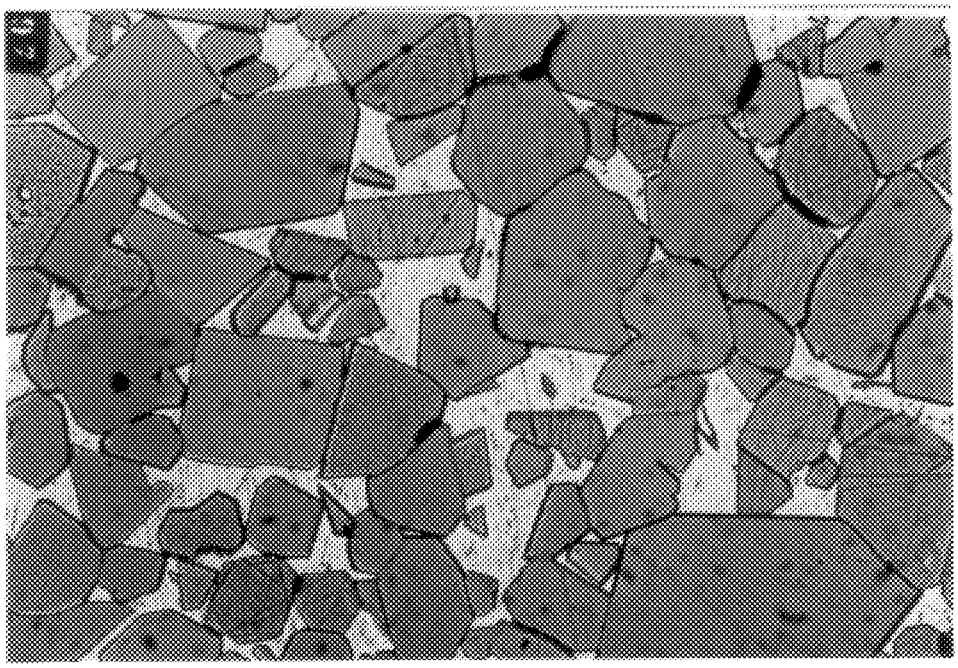
FIGS. 1 and 2 are optical micrographs of nickel bonded cemented carbide and cobalt bonded cemented carbide respectively, each of a magnification of 1 000 times.

The cemented carbide produced by the method of the invention is characterised by the use of coarse grained carbide particles and nickel as the binder phase. Such cemented carbides have been found to have a thermal conductivity higher than a similar cemented carbide utilising cobalt as the binder phase. As a result, during drilling of rock formations heat generated at the working surfaces is dissipated more readily from the bulk structure thereby reducing the incidence of thermal cracking or "snakeskin". This property makes the cemented carbide well suited as the material for making the cutting elements of soft rock mining tools and road planing tools. Soft rock has a compression strength below 240 MPa and generally below 100 MPa. Examples of such rock are coal, sandstone, shale and potash.

The carbide particles may be any known in the art such as tungsten carbide particles, titanium carbide particles, tantalum carbide particles, or molybdenum carbide particles. The preferred carbide particles are tungsten carbide particles.

The carbide particles are coarse grain having an average size of at least 10 microns. Typically the carbide particles will have a size in the range 10–50 microns and preferably 20–40 microns.

The binder is nickel and is used in the starting mixture in particulate form. The nickel powder will preferably be a fine powder having a particle size of less than 5 microns, preferably 1–3 microns All particle sizes in the specification and claims mean average particle sizes.

The sintering of the mixture into the cemented carbide will take place under known conditions. Generally the sintering temperature of 1300°to 1500° C. will be used. Sintering will generally take place at a pressure of less than $2\times10^{-2}$ mbar or sinter hipping at an overpressure of 10–50 bars in the presence of an inert gas.

The cemented carbide produced by the method of the invention may be used for making a known cutting element for a soft rock mining tool such as a pick. An example of such a cutting element is illustrated in European Patent Application No 0 288 775, which is incorporated herein by reference.

The invention will now be illustrated by the following examples.

EXAMPLE 1

A powder mixture of coarse grain tungsten carbide (average particle size of greater than 20 microns), nickel (e.g. ultra fine powder having an average particle size of less than 1 micron) tungsten metal and carbon was milled in a ball mill with hexane containing 2% by weight of paraffin wax. The ball/charge ratio is 1:1. The mining speed was 65 rpm and the milling time 12 hours. After mining, the powdered mixture was dried and granulated. The granulated powder was then pressed in the conventional manner into various test components. The waxed, as-pressed components were sintered in a combined dewax, preheat, sinter cycle at about 1380° C. The sintering cycle involved sintering under a pressure of less than $2\times10^{-2}$ mbar followed by sintering in the presence of argon at a pressure above atmospheric, typically 45 bar overpressure.

The sintered products had the following compositions:

| Components | % by mass - range |
|---|---|
| Tungsten Carbide | 88% to 97% |
| Nickel | 12% to 3% |

The sintered product was found to have a coarse tungsten carbide phase (typically 6–25 micron) and a nickel binder phase.

EXAMPLE 2

A coarse grain WC starting powder between 20–40 microns was milled with a nickel powder of grain size 1–3 microns. The milling conditions were:

| | |
|---|---|
| Ball Mill | for 12 hours |
| Ball Size | 14 mmϕ |
| Mill Speed | 65 rpm |
| Ball/Charge Ratio | 1:1 |
| Milling Agent | Hexane |
| Slurry Ratio | 70–80% |
| 2% wax added to mill as pressing lubricant | |

After the milling process, the powder was dried in the ball mill under vacuum in a water bath at 75° C. The dried powder was screened to remove the 14 mm diameter milling balls, followed by granulation in a drum granulator to obtain a granule size fraction between 90 and 350 microns.

The granulated powder was compacted in a hydraulic press using a pressure between 9,3 to $23\times10^7$ Pa to the desired shape of cutting inserts.

The pressed components were sintered using a combined dewax, pre-heat, sinter-cycle at 1,450° C. and an argon overpressure typically of 45 bar. ($45\times10^5$ Pa).

The as-sintered components were then brazed into an EN19 steel body in order to produce a coal tool pick.

The cemented carbide produced by the examples described above has been found to be more resistant to stress corrosion cracking under acidic conditions encountered in mines and other environments, has a higher thermal conductivity due to the larger grain morphology and the nickel binder and is less susceptible to "snakeskin" or thermal cracking during the drilling of rock formations than a similar cemented carbide utilising cobalt as the binder phase.

The following table shows the comparative data for 9.5% nickel and 9.5% cobalt cemented tungsten carbide (WC) produced under similar processing conditions described above.

| | 9.5% cobalt + WC | 9.5% nickel + WC |
|---|---|---|
| Density g/cm$^3$ | 14.52 | 14.48 |
| Magnetic Saturation emu/g | 172 | 44 |
| Coercive Force (oersteds) | 60 | 25 |
| Hardness Hv30Kg/m$^2$ | 1055 | 780 |
| Porosity Rating | <A02 B00 C00 | <A02 B00 C00 |
| Gram Size (microns) | 5.3 | 7.0 |
| Roundness Factor (R) | 1.67 | 1.47 |

Figure 2:
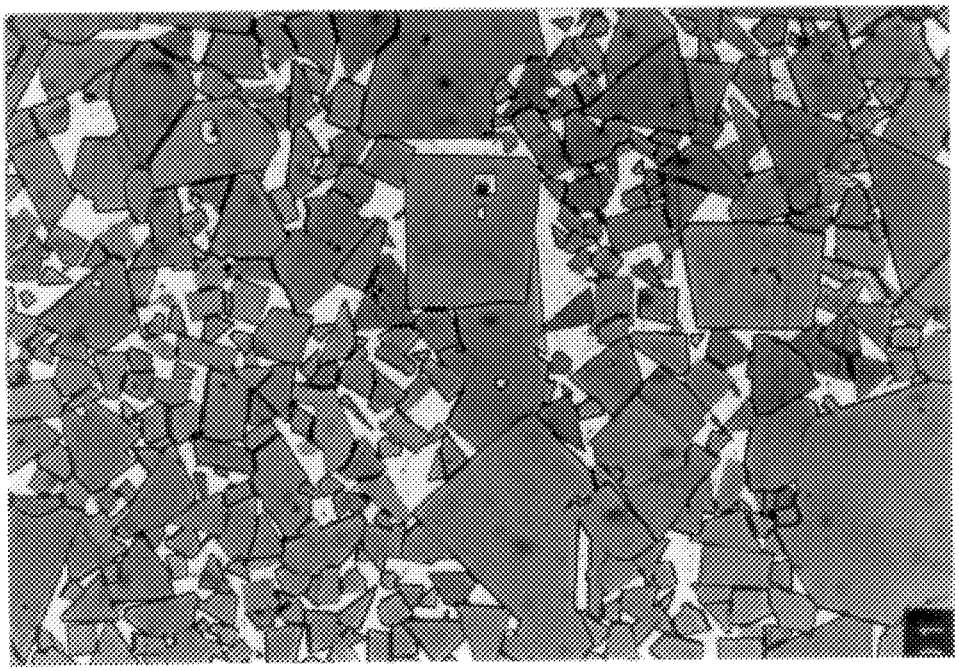

Typical optical micrographs of the nickel bonded inserts and the cobalt bonded inserts are shown in FIG. 1 and FIG. 2, at the same magnification (×1000).

An analysis of at least 1000 grains on the Leica Image Analyser revealed that the nickel bonded material had a grain size of 7.0 microns and the cobalt bonded material a gram size of 5.3 microns. This grain size difference is also reflected in the recorded hardness levels.

It was also noticeable that the WC grains are more rounded in the nickel matrix and they are more angular in the cobalt matrix. The Leica image Analyser measures a feature called roundness. When the roundness factor is R=1, then the particle is perfectly round, i.e. the distance from the centre to any edge is the same. The WC in the nickel bonded grade had an R value of 1.47 and the WC in the cobalt bonded grade had an R value of 1.67. This indicates that the WC grains are more rounded in the nickel bonded product.

FIELD TEST DATA

Picks using inserts made from the 9.5% nickel bonded WC were field tested at Goedehoop Colliery. Standard cobalt picks were also tested on a JOY 12 HM21 continuous miner on the same drum. The colliery uses the bord and pillar mining technique cutting headings 6.5 metres wide and 4.0 metres high with a continuous miner.

The 56 picks on the drum were replaced with 28 nickel bonded picks and 28 standard cobalt bonded picks, randomly positioned. Each pick was numbered so that a record of the coal tonnage cat per pick could be monitored.

On average the nickel bonded picks cut 45.5 tonnes of coal per pick as compared to the 38.6 tonnes per pick of the standard cobalt grade. This is an improvement 17.8%.

The wear mechanisms of the nickel bonded and cobalt bonded WC picks were investigated both optically and with the scanning electron microscope. Macroscopically the wear surfaces of the two hardmetal grades were very similar.

The wear progressed by even radial wear of the insert followed by development of wear fats and larger pieces are then worn by fracture and abrasion from the surface. This is the macroscopic mode of failure for both the nickel bonded and cobalt bonded picks.

On a microscopic scale the wear surface of the cobalt bonded WC was found to be different to that of the nickel in that there was less pull out of the WC grains. In the case of the cobalt bonded WC it seems that the WC grains fracture before they are worn from the surface.

Figure 3:
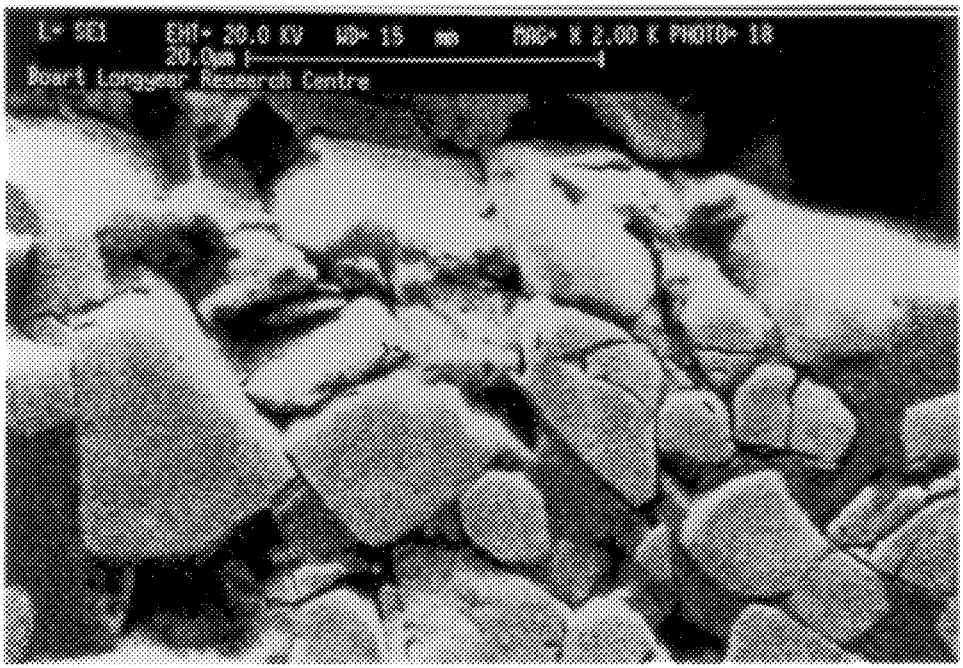
FIG. 3 and 4 are scanning electron micrographs of the wear surfaces of nickel and cobalt bonded cemented carbide.
Figure 4:
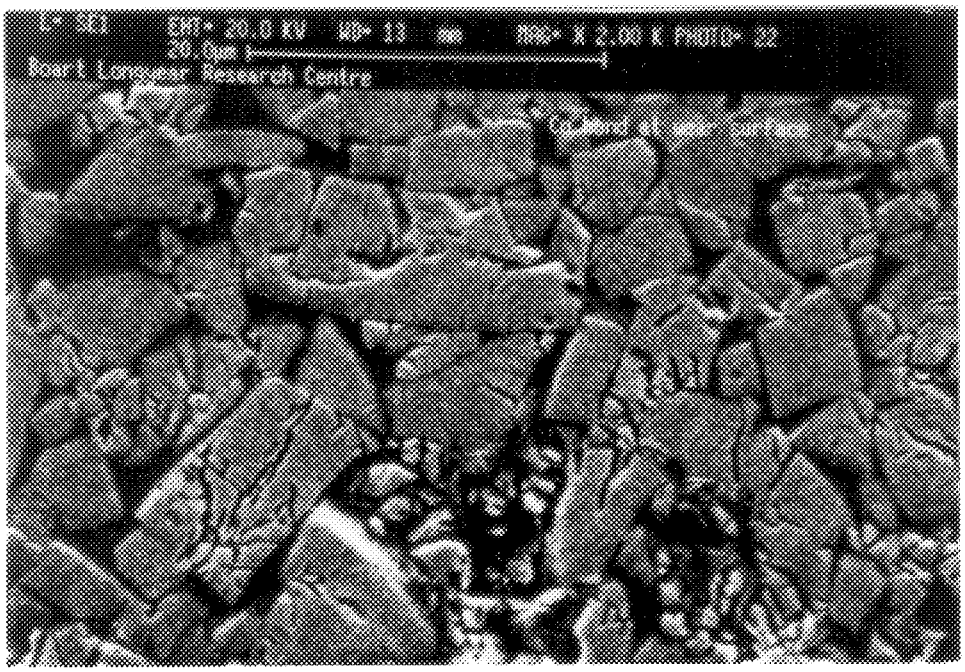

Typical scanning electron microphotographs at the same magnifications show the difference between the wear surfaces of the nickel and cobalt bonded picks—see FIGS. 3 and 4. The cobalt bonded wear surface exhibits WC grains containing numerous cracks, which are not evident on the wear surface of the nickel bonded wear surface.

We claim:

1. A cemented carbide cutting element for a soft rock mining tool or a road planing tool which is resistant to stress corrosion in acidic water environments comprising: a cemented carbide produced by sintering a mixture of coarse grain carbide particles and a nickel binder in particulate form wherein the nickel binder has a particle size of less than 5 microns, and wherein the coarse grain carbide particles have a particle size of 10–50 microns which, in combination with the nickel binder having a particle size less than 5 micons endows the cutting element with the stress corrosion resistance in acidic water environments.

2. A cemented carbide cutting element according to claim 1, wherein the coarse grain carbide particles have an average particle size of 20–40 microns.

3. A cemented carbide cutting element according to claim 1, wherein the nickel binder has a particle size of 1–3 microns.

4. A cemented carbide cutting element according to claim 1, wherein the sintering of the mixture takes place at a temperature in the range of 1300°–1500° C.

* * * * *